United States Patent [19]

Hino et al.

[11] 4,453,393

[45] Jun. 12, 1984

[54] FOUR HIGH MILL OF THE PAIRED-ROLL-CROSSING TYPE

[75] Inventors: Hiroyuki Hino; Kunio Yamamoto; Ryuichi Ozono; Hiroshi Aratani; Susumu Kawamoto, all of Hiroshima, Japan

[73] Assignee: Mitsubishi Jukogyo Kabushiki Kaisha, Japan

[21] Appl. No.: 292,492

[22] Filed: Aug. 13, 1981

[51] Int. Cl.[3] ..... B21B 29/00; B21B 31/16

[52] U.S. Cl. ..... 72/243; 72/245; 72/248

[58] Field of Search ..... 72/241, 243, 244, 245, 72/248

[56] References Cited

U.S. PATENT DOCUMENTS 3,526,118 9/1970 O'Brien ..... 72/243

FOREIGN PATENT DOCUMENTS 55-64908 5/1980 Japan .

55-153605 11/1980 Japan ..... 72/241

55-153606 11/1980 Japan ..... 72/243

*Primary Examiner*—Francis S. Husar

*Assistant Examiner*—Steven B. Katz

*Attorney, Agent, or Firm*—McGlew and Tuttle

[57] ABSTRACT

A four high mill of a paired-roll-crossing type comprises upper and lower equalizer beams held in contact, respectively, with the uppermost and lowermost surfaces of upper and lower backup roll bearing cases and made movable upwardly and downwardly within a housing, roll-crossing devices mounted in the housing to turn the bearing cases that contain upper and lower work chocks about a common vertical axis on the same horizontal plane so that upper and lower pairs of rolls can cross each other, and devices for separately setting the left and right roll gaps between upper and lower work rolls. The mill further comprises work roll-bending devices mounted at both ends of the work rolls.

1 Claim, 3 Drawing Figures

FOUR HIGH MILL OF THE PAIRED-ROLL-CROSSING TYPE

FIELD AND BACKGROUND OF THE INVENTION

This invention relates to improvements in a four high mill of a paired-roll-crossing type.

In recent years the demand for accuracy of thickness in the width direction of rolled metals has become more and more exacting. The demand has been met by initial crowning of rolls for rolling mills to make up for the deflections of the rolls under rolling load. This countermeasure necessitates having a large variety of initially crowned rolls in reserve, since the rolls must be replaced by rolls having a different crowning amount whenever the rolling condition, such as the width and/or the thickness of the slab or strip, are to be changed. Frequent roll changing lowers the rate of mill operation. Moreover, the crowning effect on rolls is highly variable because of the wear and thermal expansion of the rolls with the progress of the rolling operation. For these reasons there has been an incessant need in the art for means of controlling the thickness of the workpiece across the width of the rolling mill without the necessity of changing the rolls.

As a solution to this control problem, bending of the work rolls has been proposed and has proven to be fairly effective. However, the strengths of the work roll shafts place limits upon the bending forces applicable, and the roll-bending method is not satisfactorily capable of correcting thickness nonuniformity in the width direction of the workpiece. Especially since the strip width is relatively narrow for barrel length of the rolls, the roll bending effect cannot be fully achieved in most cases because of the interference by the contacting ends of the backup rolls and work rolls.

Therefore, the introduction of a rolling mill has been urgently called for which can freely control the thickness of the metal across the width thereof, according to changes in the given rolling conditions, while using the same rolls.

Another disadvantage of the prior art is the necessity of frequently replacing the mill rolls, especially the work rolls, due to rapid wear during rolling operations. Conventional mills are designed to receive slabs or strips in such a manner that the middle point of the roll length matches the center of the width of each passing piece. Consequently, the middle portions of the rolls wear faster than the end portions, and a common practice has been to remove each roll for replacement when its middle portion has worn beyond a predetermined limit. This means that the roll must be dismounted when its both ends are yet to reach the wear limits. The short life and frequent replacement of the rolls have lowered the rate of mill operation, and this has combined with the economical loss due to roll wear to have a serious effect upon the cost of the product.

Thus, with the view to eliminating the disadvantages of the conventional rolling mills, this applicant has already proposed novel four high mills, as disclosed in the specifications (with drawings) of copending Japanese Patent Application Nos. 138837/1978 and 59327/1979, which are capable of controlling the thickness extensively width-wise of the workpiece using the same rolls and more than doubling their ordinary spans of life.

Those rolling mills, of the four high type, include means for separately setting the left and right roll gaps, oil hydraulic jacks for roll bending, and a paired-roll-crossing mechanism which can be adjusted to move the pair of the upper work roll and backup roll and the pair of the lower work roll and backup roll to cross each other at predetermined angles with respect to a line normal to the rolling direction. In this way they can attain the end described above.

However, when the paired-roll-crossing mechanism is adjusted to turn the upper and lower pairs of rolls to the points where they cross at certain angles to a line normal to the rolling direction, there will occur horizontal deviations of the center points of the upper backup roll bearings and those of the reduction screws, away from each other. Bending moments corresponding to the amounts of deviations will develop in the screws, adversely affecting the screw operation. Similarly, the center points of the lower backup roll bearings and those of reduction cylinders undergo relative horizontal deviations, producing bending moments in the cylinders, too, and thereby having unfavorable effects upon the same.

SUMMARY OF THE INVENTION

This invention is aimed at overcoming the drawbacks of the proposed mills, and it provides a four high mill of a paired-roll-crossing type characterized in that upper and lower equalizer beams are held in contact, respectively, with the uppermost and lowermost surfaces of upper and lower backup roll bearing cases. The beams are movable upwardly and downwardly within a housing. Roll-crossing devices are mounted in the housing to turn the bearing cases that contain upper and lower work roll chocks about a common vertical axis on the same horizontal plane so that upper and lower pairs of rolls can cross each other. Also devices are provided for separately setting the left and right roll gaps between upper and lower work rolls.

The invention also provides a four high mill of a paired-roll-crossing type comprising an upper and a lower equalizer beam held in contact, respectively, with the uppermost and lowermost surfaces of backup roll bearing cases and made vertically movable within a housing. Roll-crossing devices are mounted in the housing to turn the bearing cases that contain work roll chocks about a common vertical axis on the same horizontal plane so that upper and lower pairs of rolls can cross each other. The mill includes devices for separately setting the left and right roll gaps between upper and lower work rolls, characterized in that work roll bending devices are mounted at both ends of the work rolls.

BRIEF DESCRIPTION OF THE DRAWINGS

Other objects and advantages of the present invention will become apparent when an embodiment thereof is considered in connection with the accompanying drawing, in which.

DESCRIPTION OF THE PREFERRED EMBODIMENT

Figure 1:
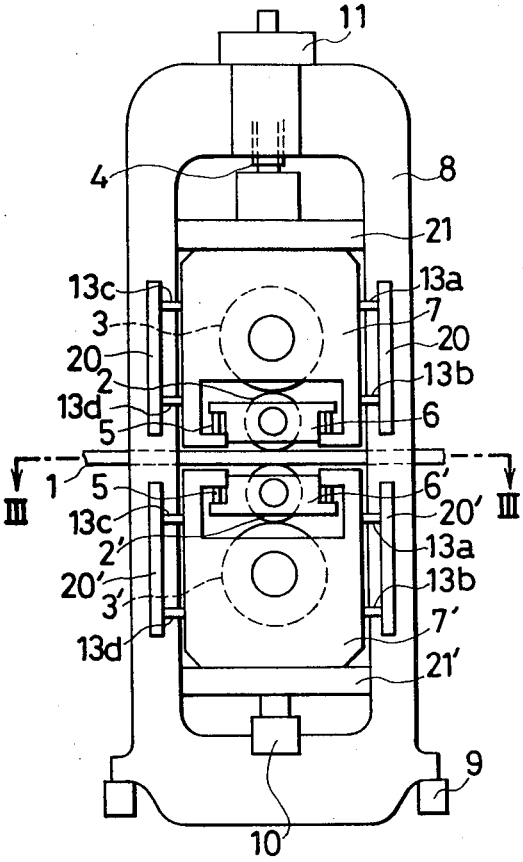
FIG. 1 is a diagrammatic front view of an embodiment of the invention.
Figure 2:
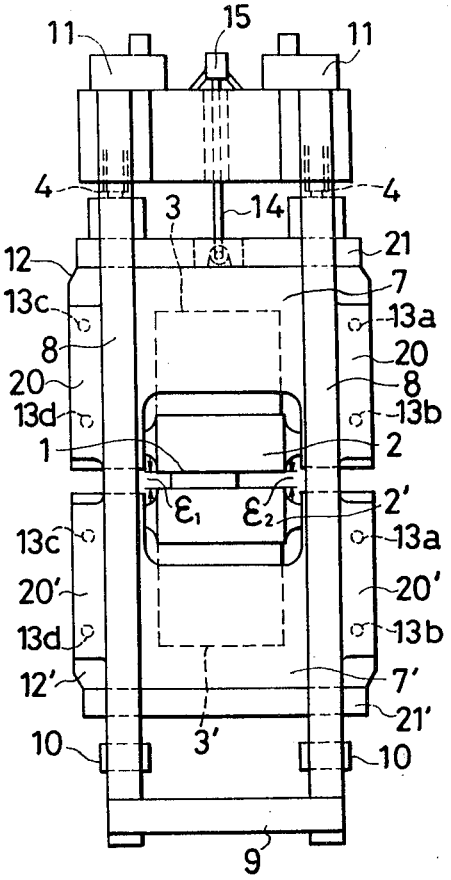
FIG. 2 is a diagrammatic side view of the embodiment.

Throughout the figures the numeral 1 indicates a slab or strip of steel to be rolled by a pair of work rolls 2, 2', which are held one above another and supported, respectively, by work roll chocks 6, 6' as shown. A pair of backup rolls 3, 3', in rolling contact with the nonworking sides of the work rolls 2, 2', are held within upper and lower bearing cases 7, 7' for the backup rolls. On tops of housing frames 8, joined together at the bottoms by shoe plates 9, are mounted a pair of screw-down devices 11 equipped with a screw 4 each. Near the lower ends of the housing frames 8, there are installed a pair of hydraulic reduction cylinders 10.

The pair of screw-down devices 11 equipped with the screws 4 constitute means for separately setting the left and right roll gaps as desired between the upper and lower work rolls 2, 2'.

The upper and lower backup roll bearing cases 7, 7' are held in a suitably spaced relation within the housing 8 so they may move upwardly and downwardly along the housing frames and also, as will be described later, they may turn about their common vertical axis. As illustrated, the upper and lower work roll chocks 6, 6' are vertically slidably housed in the upper and lower backup roll bearing cases 7, 7'. Between both ends of the backup roll bearing cases 7, 7' and those of the work roll chocks 6, 6' are interposed roll-bending devices (oil hydraulic jacks) 5, as shown in FIG. 1.

Also, between the upper backup roll bearing case 7 and the screws 4 and between the lower bearing case 7' and the hydraulic reduction cylinders 10, there are disposed thick plate-like equalizer beams 21, 21', respectively, which are movable upwardly and downwardly but are horizontally constrained unmovably by the inner walls of the housing 8.

Jacks **13*a*, 13*b*, 13*c*, and 13*d* are supported by brackets 20, 20', which in turn are provided, as shown, on the upper and lower portions on both sides of the housing 8. These jacks are operated so as to turn the upper and lower backup roll bearing cases 7, 7' on the same horizontal planes about their common vertical axis. The brackets 20, 20' combine with the jacks 13*a* to 13*d* to constitute roll-crossing devices disposed in the housing 8**.

Figure 3:
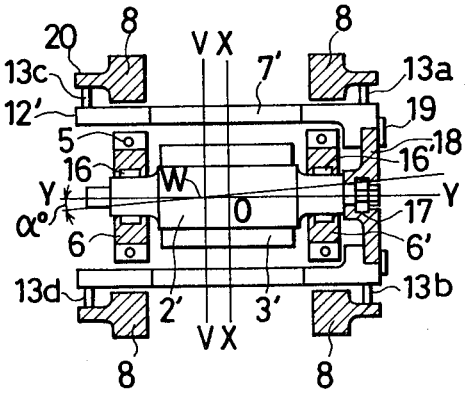
FIG. 3 is a sectional view taken along line III—III of FIG. 1.

The numeral 15 designates a cylinder for balancing the inner housing, mounted on top of the housing 8, with a rod 14 suspending the top roll assembly. Radial bearings 16, 16' for the work rolls 2, 2' are supported themselves by the work roll chocks 6, 6'. The work rolls 2, 2' (FIG. 3 showing only the roll 2' for simplicity) are each supported at one end by thrust pads 18 through thrust bearings 17. The thrust pads 18 are secured to the upper and lower backup roll bearing cases 7, 7' with chock plates 19.

Throughout the figures the numerals 12, 12' indicate upper and lower inner housings.

The construction of the four high mill of a paired-roll-crossing type embodying the invention has so far been described. Now as indicated in FIG. 3, let the line V—V be the centerline of width of a slab or strip being passed through the rolls (hereinafter called the "passing line"), the line X—X be a straight line that extends across the middle point of length of the rolls and parallel to the passing line V—V, the line Y—Y be a straight line at right angles to the line X—X, and the intersection of the passing line V—V and the line Y—Y be W. Then, the operation of the jacks **13*a*, 13*b*, 13*c*, and 13*d* for respective strokes determined by calculations will cause the upper and lower backup roll bearing cases 7, 7' to turn horizontally with respect to the given point W on the line Y—Y, thus turning the upper and lower rolls 2,2' and 3, 3' in pairs relative to each other through an angle $\alpha°$. (Refer to FIG. 3**.)

The initial roll gaps $\epsilon_1$, $\epsilon_2$ between the upper and lower work rolls 2, 2' can be adjusted by suitably operating the left and right screw-down devices 11. Also, proper control of the roll-bending forces $F_1$, $F_2$ is made possible by the roll-bending devices 5.

Thus, by adjusting the turning angle $\alpha°$, initial roll gaps $\epsilon_1$, $\epsilon_2$ of the upper and lower work rolls 2, 2', and the roll-bending forces $F_1$, $F_2$, the sectional contour across the workpiece 1 being rolled can be adjusted over a broad range of width.

Since the pairs of upper and lower rolls 2, 3 and 2', 3' can cross at the point W, the roll crowning effects can be made equal on the left and right portions of the rolls.

With the four high mill of a paired-roll-crossing type according to the invention, built and designed to function in the manner described above, it is possible to control the sectional contour of the workpiece over a great range of width. Further, because rolling at either end portions is possible, the work rolls may be worn while generally maintaining the original cylindrical contours. This presents practical advantages of not only more than halving the intervals of work roll changing and more than doubling the total tonnage of rolling but also providing by far the lowermost cost of fabricating and regrinding the rolls 2, 2', 3, 3', which do not have to be crowned rolls as in the prior art, but may be simple cylindrical rolls.

What is claimed is:

1. A four high roll mill comprising:

a pair of spaced housing frames each having at least one opening therethrough;

an upper bearing case movably mounted for vertical and horizontal movement with respect to said frames and having opposite ends extending respectively through openings of said frames;

an upper backup roll rotatably mounted to said upper bearing case;

an upper workroll chock movably mounted for vertical movement to said upper bearing case;

an upper work roll rotatably mounted to said upper chock and engageable against said upper backup roll;

a lower bearing case movably mounted for vertical and horizontal movement with respect to said frames and having opposite ends extending respectively through openings of said frames;

a lower backup roll rotatably mounted to said lower bearing case;

a lower workroll chock movably mounted for vertical movement to said lower bearing case;

a lower workroll rotatably mounted to said lower chock and engageable with said lower backup roll;

bearing case turning means connected between said upper and lower bearing cases and said frames for pivoting said upper and lower bearing cases in opposite directions;

workroll bending jacks connected between said upper workroll chock and said upper bearing case and between said lower workroll chock and said lower bearing case for bending said upper and lower workrolls by selected amounts;

a relatively thick plate-like beam vertically movable and horizontally fixed with respect to said housing frames and having opposite ends extending through said respective openings of said frames and fully across said respective openings, connected between each of said upper and lower bearing cases and said frames;

pressing means connected between one of said equalizing beams and said frame for moving one of said bearing cases against the other of said bearing cases; and gap adjusting means connected between the other of said equalizer beams and said frames for adjusting a gap between said upper and lower workrolls at either end of said upper and lower workrolls.

* * * * *